US010463465B2

(12) United States Patent
Trow

(10) Patent No.: US 10,463,465 B2
(45) Date of Patent: Nov. 5, 2019

(54) APPLICATOR

(71) Applicant: Simcro Limited, Hamilton (NZ)

(72) Inventor: David Andrew Trow, Hamilton (NZ)

(73) Assignee: Simcro Limited (NZ)

( * ) Notice: Subject to any disclaimer, the term of this patent is extended or adjusted under 35 U.S.C. 154(b) by 0 days.

(21) Appl. No.: 13/850,997

(22) Filed: Mar. 26, 2013

(65) Prior Publication Data

US 2013/0261532 A1 Oct. 3, 2013

(51) Int. Cl.
*A61D 7/00* (2006.01)

(52) U.S. Cl.
CPC ..... *A61D 7/00* (2013.01)

(58) Field of Classification Search
CPC ..... A61M 5/31511; A61M 5/31513; A61M 2005/3123; A61M 5/204; A61M 35/003; A61M 11/007; A61J 2001/2062; B05B 11/3095; B05B 11/3074; B05B 1/304; B05B 11/0016; B67D 5/22
USPC ..... 222/42
See application file for complete search history.

(56) References Cited

U.S. PATENT DOCUMENTS 3,659,749 A * 5/1972 Schwartz ..... 222/129
3,948,285 A 4/1976 Flynn
4,033,346 A * 7/1977 Phillips et al. ..... 604/208
4,046,292 A * 9/1977 Corsette ..... B05B 11/3022 222/383.1
4,227,650 A 10/1980 McKinney
4,260,082 A * 4/1981 Rooney ..... B05B 9/0883 222/340
4,594,058 A * 6/1986 Fischell ..... 417/413.1
4,674,526 A 6/1987 Athanassiu
4,768,542 A * 9/1988 Morris ..... 137/204
5,026,346 A * 6/1991 Spanner et al. ..... 604/110
5,322,191 A 6/1994 Johnson et al.
5,437,627 A * 8/1995 Lecuyer ..... 604/9
5,542,918 A * 8/1996 Atkinson ..... 604/27
5,643,195 A * 7/1997 Drevet et al. ..... 604/9
5,685,851 A * 11/1997 Murphy et al. ..... 604/150
5,862,802 A * 1/1999 Bird ..... 128/204.18
5,944,703 A * 8/1999 Dixon et al. ..... 604/319
5,988,452 A * 11/1999 Dent et al. ..... 222/309
6,024,120 A * 2/2000 Yam et al. ..... 137/495
6,209,578 B1 * 4/2001 Newton ..... 137/505.41
6,554,161 B2 * 4/2003 Main ..... 222/43
6,770,062 B2 * 8/2004 Phung et al. ..... 604/320
7,240,676 B2 * 7/2007 Rutter ..... 128/207.16
(Continued)

FOREIGN PATENT DOCUMENTS

EP 0080112 6/1983
WO 2010098683 9/2010

*Primary Examiner* — Scott J Medway
(74) *Attorney, Agent, or Firm* — Lowe Graham Jones PLLC

(57) ABSTRACT

An applicator 102 has a fluid supply inlet (14), an outlet (4) and a barrel (1) having a barrel outlet (2) and a barrel inlet (15*a*). The barrel inlet (15) is in fluid communication, or selective fluid communication, with the fluid supply inlet (14).

A one way outlet valve (3) is in fluid communication with the barrel outlet (2) and with the outlet (4). The applicator 100 has piston actuation means (32) for moving a piston (5) relative to the barrel (1). The applicator further comprises pressure limiting means (10) for limiting a maximum pressure of fluid entering the barrel (1) from the fluid supply inlet (14).

20 Claims, 8 Drawing Sheets

(56) References Cited

U.S. PATENT DOCUMENTS

| | | | | |
|---|---|---|---|---|
| 8,505,784 | B2 * | 8/2013 | Trow et al. | 222/323 |
| 2003/0114789 | A1 * | 6/2003 | Haar et al. | 604/69 |
| 2004/0143224 | A1 * | 7/2004 | Field et al. | 604/195 |
| 2006/0147351 | A1 * | 7/2006 | Falb et al. | 422/100 |
| 2007/0194054 | A1 * | 8/2007 | Ganzeboom et al. | 222/190 |
| 2012/0091229 | A1 * | 4/2012 | Laidler | B05B 7/0037 239/330 |
| 2013/0102980 | A1 * | 4/2013 | Stubber | 604/320 |
| 2015/0251842 | A1 * | 9/2015 | Rymer | A61D 7/00 222/401 |

* cited by examiner

APPLICATOR

The present invention relates to fluid applicators, and in particular, but not exclusively, to applicators for use in applying animal remedies.

PRIORITY CLAIM

This application claims the benefit of New Zealand Application Number 599027 filed Mar. 26, 2012, the contents of which are incorporated by reference.

BACKGROUND OF THE INVENTION

Animal remedies for sheep, cattle and the like are applied by a number of methods including topical or "pour-on" application, oral application, injection and nasal infusion. Each of these is typically dispensed from a "pistol grip" style dispensing means.

Typically such applicators have a piston or plunger which can be reciprocated within a barrel by squeezing and releasing a first handle relative to a second handle. The liquid to be dispensed is drawn into the barrel through an inlet via a one way inlet valve when the plunger is withdrawn inside the barrel, and is dispensed through a nozzle via an outlet valve when the plunger is extended towards the outlet valve. Such an applicator is described in the applicant's New Zealand patent No. 521084, the contents of which are herein incorporated by reference.

As is described above, conventional fluid applicators incorporate two one-way valves. These valves are referred to as the inlet valve and the outlet valve.

The valves are typically biased with springs, so that they open only when there is a predefined difference in the fluid pressure between the upstream side of the valve and the downstream side. Fluid cannot flow backwards through either valve, as flow in this direction will tend to push the valves more tightly closed.

When the applicator is at rest, both valves are closed. When the applicator is in use, it is intended that only one valve opens at a time. During the discharge stroke, the outlet valve is pushed open by the raised fluid pressure within the barrel. During the refill stroke, the inlet valve is pushed open by fluid entering the barrel (where there is now a partial vacuum).

A problem with conventional applicators is that they require a relatively large force to squeeze the handles together during the application stroke of the piston. This may be fatiguing for the operator, particularly when the applicator is used to treat a large group of animals.

The large force is required because the outlet valve of a conventional applicator is set to open only when there is a relatively large pressure in the barrel of the applicator. The reasons for this are as follows:

Firstly, the momentum of fluid travelling through the feed tube causes a pressure pulse (sometimes referred to as water hammer) at the completion of the refill stroke. The magnitude of this pressure pulse depends on factors such as the fluid velocity and the hardness of the feed tube. This pressure pulse can potentially force open both the inlet valve and the outlet valve simultaneously, and result in an unwanted discharge of fluid from the applicator. End-users strongly dislike this discharge of fluid, even if it is only a small volume.

Secondly, if the fluid supply container is held higher than the applicator (for example in a backpack) then the increased pressure can cause the fluid to flow continuously through the applicator, even when it is not squeezed, or it may drip continuously.

It would be useful to develop an applicator which allows for an outlet valve which opens under a lower pressure than the applicators of the prior art, but which does not allow any unwanted discharge of fluid from the applicator outlet.

When the applicator is used in the veterinary and/or animal husbandry fields it should preferably have the following characteristics:

- be simple and reliable, suited to use in an agricultural environment.
- be inexpensive to implement.
- not interfere with the dose accuracy of the applicator.
- work regardless of the height of the fluid source relative to the applicator.
- work regardless of the viscosity of the fluid.
- work regardless of the speed of discharge or refill.
- work correctly during all stages of the applicator's operating cycle, including discharge, refill, and unexpected pauses in mid-stroke.
- withstand attack by aggressive chemicals.

Throughout the description and the claims, all reference to pressures are to gauge pressures, i.e. pressure relative to the ambient pressure. Therefore, a reference to zero pressure means ambient pressure. Reference to negative pressure means suction. Reference to a partial vacuum is any pressure below ambient pressure but greater than a total vacuum.

Reference to the "upstream" direction is towards the direction in the fluid flow path from which fluid enters the applicator. Reference to the "downstream" direction is to the direction in which the fluid normally flows.

The reference to any prior art in the specification is not, and should not be taken as, an acknowledgement or any form of suggestion that the prior art forms part of the common general knowledge in any country.

OBJECT OF THE INVENTION

It is an object of a preferred embodiment of the invention to provide an applicator which will overcome or ameliorate at least one problem with such applicators at present, or at least one which will provide a useful choice.

Other objects of the present invention may become apparent from the following description, which is given by way of example only.

BRIEF SUMMARY OF THE INVENTION

According to one aspect of the present invention there is provided an applicator comprising:

- a fluid supply inlet;
- an outlet;
- a barrel having a barrel outlet and a barrel inlet which is in fluid communication, or selective fluid communication, with the fluid supply inlet;
- a one way outlet valve in fluid communication with the barrel outlet and with the outlet;
- a piston moveable relative to the barrel and in sealing engagement with the barrel;
- piston actuation means for moving the piston relative to the barrel;
- the applicator further comprising pressure limiting means for limiting a maximum pressure of fluid entering the barrel from the fluid supply inlet.

Preferably, the pressure limiting means is configured such that the fluid entering the barrel has a pressure which is at or below an ambient atmospheric pressure.

Preferably, the pressure limiting means is configured such that the fluid entering the barrel has a pressure which is at or below a pressure required to open the outlet valve.

Preferably, the pressure limiting means is provided at or adjacent the barrel inlet.

Preferably, the pressure limiting means is integral with the piston.

Preferably, the pressure limiting means comprises a diaphragm.

Preferably the diaphragm is annular in shape.

Preferably a first side of the diaphragm is in fluid communication, or selective fluid communication, with fluid in the barrel.

Preferably an opposite second side of the diaphragm is exposed to ambient atmospheric pressure.

Preferably displacement of the diaphragm changes an internal volume of a conduit supplying fluid to the barrel inlet.

Preferably the diaphragm is carried by the piston.

Preferably the applicator is provided with a one way valve means for preventing fluid flow from the barrel though the barrel inlet.

Preferably the pressure limiting means is adapted to prevent fluid flow from the barrel inlet to the fluid supply inlet.

Preferably the pressure limiting means comprises a first valve head and a first valve seat, wherein the first valve head can be moved from a closed position to an open position by movement of the diaphragm.

Preferably the pressure limiting means comprises a second valve head and second valve seat, wherein the second valve head is connected to the first valve head and moves with the first valve head.

Preferably a pressure difference across said first valve head is substantially equal to a pressure difference across said second valve head.

Preferably the pressure difference across said first valve head creates a resultant force in a first direction and the pressure difference across said second valve head creates a resultant force in a second direction which is opposite to the first direction.

Preferably the resultant forces are substantially equal.

Preferably the resultant force on the second valve head is greater than the resultant force on the first valve head.

According to a second aspect of the present invention there is provided an applicator comprising:

a fluid supply inlet;

an outlet;

a barrel having a barrel outlet and a barrel inlet in fluid communication, or selective fluid communication, with the fluid supply inlet;

a one way outlet valve in fluid communication with the barrel outlet and with the outlet;

a piston moveable relative to the barrel and in sealing engagement with the barrel;

piston actuation means for moving the piston relative to the barrel; and a diaphragm in fluid contact, or selective fluid communication, with a fluid within the barrel, wherein movement of the diaphragm controls a valve means provided between the fluid supply inlet and the barrel inlet.

According to a third aspect of the present invention there is provided an applicator system comprising an applicator and fluid supply conduit, the applicator comprising:

a fluid supply inlet;

an outlet a barrel having a barrel outlet and a barrel inlet in fluid communication, or selective fluid communication, with the fluid supply inlet;

a one way outlet valve in fluid communication with the barrel outlet;

a piston moveable relative to the barrel and in sealing engagement with the barrel;

piston actuation means for moving the piston relative to the barrel;

the fluid supply conduit having an inlet and an outlet which is in fluid communication, or selective fluid communication, with the fluid supply inlet of the applicator;

the system further comprising pressure limiting means for limiting a maximum pressure of fluid entering the barrel in use.

According to a further aspect of the present invention there is provided an applicator substantially as herein described with reference to any one of FIGS. 1 to 3, FIGS. 4 and 5, or FIGS. 6 to 8.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF PREFERRED EMBODIMENTS OF THE INVENTION

Figure 1:
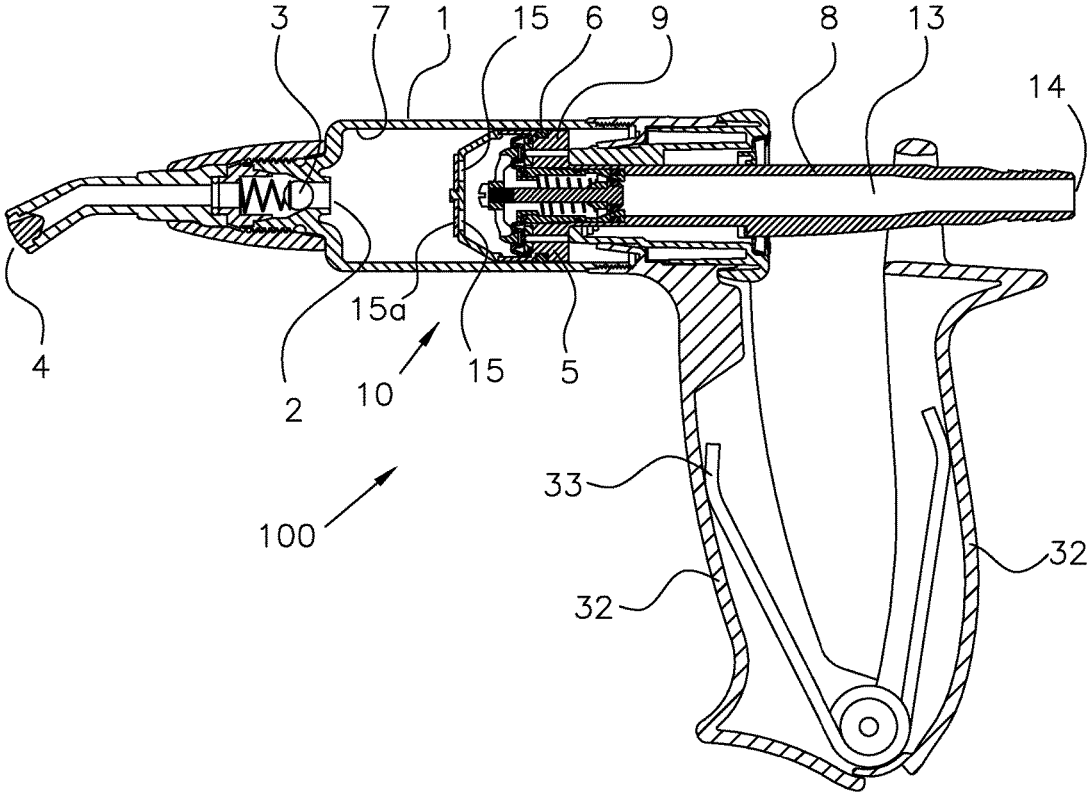
FIG. 1 Is a diagrammatic cross-section side view of an applicator according to one embodiment of the present invention.
Figure 2:
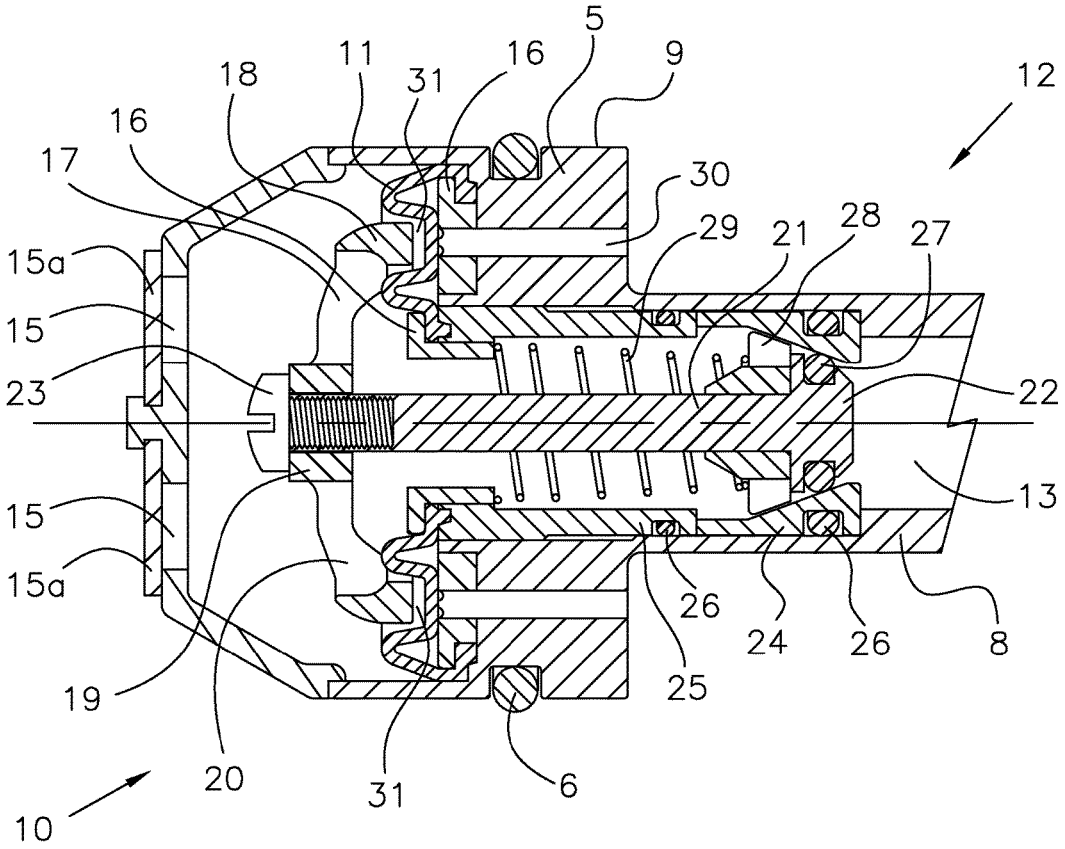
FIG. 2 Is an enlarged diagrammatic cross-section side view of the piston head and pressure limiting means of the applicator shown in FIG. 1 with the pressure limiting valve closed.

Referring first to FIGS. 1, and 2, an applicator according to one embodiment of the present invention is generally referenced by arrow 100.

The applicator 100 has a barrel 1 with an outlet 2. A one way outlet valve 3 is provided at or adjacent the barrel outlet 2. The barrel outlet 2 is in selective fluid communication with an applicator outlet 4 from which fluid is discharged in use. In other embodiments (not shown) the one way valve 3 may be provided at or adjacent the applicator outlet 4.

A piston or plunger 5 is located within the barrel 1 and has sealing means 6, for example an O-ring seal, to sealingly engage an inner surface 7 of the barrel 1.

In the embodiment shown the piston 5 has an integral hollow pushrod 8 and a substantially cylindrical head 9 that travels along the cylindrical barrel.

The piston 5 is provided with a pressure limiting means, generally referenced by arrow 10.

In the embodiment shown, the pressure limiting means 10 comprises a flexible diaphragm 11 connected to a valve means, generally referenced 12. The valve means 12 is provided inside the hollow pushrod 8, the hollow pushrod providing a conduit 13 between a fluid inlet 14 and an inlet 15 to the barrel. In the embodiment shown, a one way valve means 15*a* is provided to prevent flow from the barrel 1 towards the inlet 14.

The diaphragm 11 is preferably annular in shape, and is clamped (and sealed) to the piston head 9 by clamping means 16.

A force transfer component 17 is provided which consists of an outer ring or hub 18 provided in front of the diaphragm 11, and an inner hub 19, with the two being connected by several spokes 20. The spokes 20 allow fluid to pass through the component 17.

The valve means 12 comprises a valve stem 21 connected to a valve head 22.

The force transfer component 17 is connected to the valve stem 21 by suitable connecting means, for example screw 23. The connection between the force transfer component 17 and the valve stem 21 may have a degree of flexibility, to allow for misalignment between the parts without upsetting correct operation. In some embodiments the valve stem 21 may be able to slide through force transfer component 17 without moving the latter with it, but the force transfer component 17 cannot move forward (i.e, further into the barrel) without contacting screw 23 and also moving the valve stem 21, and thereby opening the valve 12.

A valve seat 24 and spacer 25 are fixed in place in the plunger conduit. O-ring seals 26 prevent leakage past the spacer 25 and valve seat 24.

The valve head 22 is provided with a suitable sealing means, preferably an O-ring seal 27. The valve head 22 seals against the valve seat 24 when in a closed position (as shown in FIG. 2). The valve head 22 is preferably frusto-conical in shape, and the valve seat 24 is preferably a complimentary shape.

A valve travel limiting means, for example one or more fins or tabs 28, is arranged to limit the travel of the valve head 22. In the embodiment shown the tabs 28 contact spacer 25 when the valve head 22 has moved a predetermined maximum distance away from the valve seat 24.

A biasing means, for example spring 29, urges the valve head 22, and the components connected to the valve head, including the force transfer component 17, in the upstream direction.

A vent means 30 may be provided in the piston head 9 to ensure that the side of the diaphragm 11 which is not in contact with the fluid in the barrel is maintained at ambient atmospheric pressure.

In the embodiment shown the relationship between the force transfer component 17 and the diaphragm 11 is such that a clearance space 31 is maintained between them when the diaphragm 11 is in its relaxed state, as shown in FIG. 2. This occurs when the valve 12 is closed and the pressure inside the barrel 1 is substantially equal to atmospheric pressure (as shown). This allows spring 29 to bias valve head 22 and O-ring 27 against the valve seat 24 without interference.

In some embodiments guide means (not shown) may be provided to ensure that the valve stem 21 remains on-centre at its forward end.

FIG. 2 shows the positions of the components when the pressure inside the barrel 1 is substantially equal to atmospheric pressure. The diaphragm 11 is in its relaxed position, and the valve 12 is held closed by spring 29.

The force of spring 29 is sufficient to hold valve 12 closed against the pressure of the fluid in the conduit 13, even if the fluid reservoir (not shown) which supplies fluid to the fluid inlet 14 is raised a limited distance above the applicator 100.

When the user operates the actuating means (handles 32 in the embodiment shown) to drive the piston 5, the piston 5 is pushed forwards and displaces fluid which flows through the one-way outlet valve 3 and out through the outlet 4. The force required to open the outlet valve 3 causes the pressure inside the barrel 1 to rise above atmospheric pressure. In the embodiment shown the one way valve 15*a* prevents this pressure from pushing the diaphragm 11 rearwards against the piston 5. The diaphragm 11 does not move from the position shown in FIG. 2 during this phase of operation. Valve 12 is still held closed by spring 29.

In preferred embodiments the outlet valve 3 is configured to open under a lower pressure than the outlet valves of conventional applicators. This reduces the pressure of the fluid within the barrel during the application stroke, and hence reduces the required hand squeeze force on the handles 32.

When the user releases the handles 32, a biasing means, for example a handle spring 33 provided inside the handles 32, pulls the piston 5 rearwards. This induces a partial vacuum inside the barrel 1, which is communicated to the diaphragm 11 through the inlet 15 and one way valve 15*a*.

Air pressure acting on the rearward-facing side of the diaphragm 11 pushes the diaphragm forwards, closing clearance space 31. The diaphragm 11 then pushes forwards against the force transfer component 17. When the pressure of the fluid in the barrel 1 is low enough, the force generated by the diaphragm 11 overpowers the spring 29 and moves the valve head 22 away from the valve seat 24, as shown in FIG. 3, thereby allowing fluid to flow through the valve 12.

The distance that the valve 12 opens depends (amongst other things) on how low the pressure in the barrel 1 is. The valve 12 may open fully, or only part-way. In some embodiments the stiffness of the diaphragm 11 may cause it to act like a spring, adding to the biasing force created by spring 29.

Figure 3:
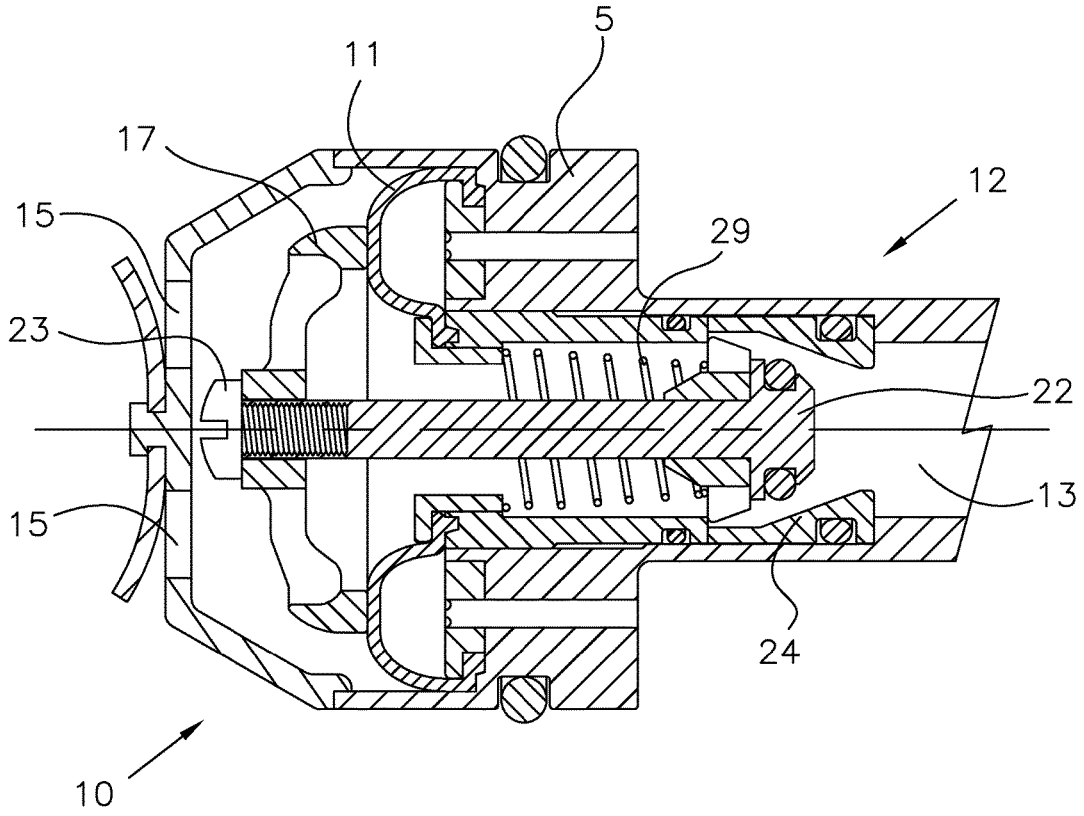
FIG. 3 Is an enlarged diagrammatic cross-section side view of the piston head and pressure limiting means of the applicator shown in FIG. 1 with the pressure limiting valve open.

FIG. 3 shows the assembly with the diaphragm 11 deflected and the valve 12 fully open. This occurs when the piston 5 is being retracted and the barrel 1 is filling with fluid through the valve 12 and inlet 15.

At the end of the barrel refilling stroke the piston 5 contacts a fixed stop. The stop is typically part of a variable dosage control means. Suitable dosage control means are known to the art, and include that described in the applicant's New Zealand patent number 521084, the contents of which are included herein by reference.

The momentum of the fluid flowing in the conduit 13 and in the upstream supply tube (not shown) may tend to keep the fluid moving past the valve 12 and into the barrel 1, even though the spring 29 is acting on the valve head 22 to try to close the valve 12. If this occurs, the pressure in the barrel 1 rises and the diaphragm 11 moves rearward, pulled back by the spring 29 acting on the diaphragm via the force transfer component 17.

The valve 12 returns to its substantially closed position before the rising pressure in the barrel 1 reaches atmospheric pressure. Closure of the valve 12 may result in a pressure pulse (from water hammer) in the conduit 13 and the preceding supply tube. However, the force of the spring 29 may be sufficient to keep the valve 12 substantially closed despite the momentary increase in pressure caused by the pressure pulse. Since the pressure pulse cannot pass the closed valve 12, the problem of fluid discharging from the nozzle at this time is avoided. Since the valve 12 is opened by the diaphragm 11 when necessary, the spring 29 may be selected to provide a larger biasing force than that used by the applicators of the prior art.

Assuming that there are no leaks, the pressure in the barrel 1 remains slightly below atmospheric pressure. Because no more fluid can pass the closed valve 12, the diaphragm 11 may remain deflected slightly forwards, touching the force transfer component 17 (i.e. the clearance space 31 is closed).

Those skilled in the art will appreciate that although the pressure in the barrel 1 of the embodiment described above is below atmospheric at the end of the inlet stroke, other embodiments may be configured such that the pressure is at or above atmospheric pressure at that stage. In particular, the water hammer pressure pulse may be large enough to force a small volume of fluid past valve 12, preventing the valve from closing fully, or even reopening it slightly, despite the biasing force of the spring 29. The passage of this small volume of fluid will displace the diaphragm rearward, reopening a gap between the force transfer component 17 and the diaphragm 11. There may be a corresponding rise in the pressure of the fluid in the barrel. While this pressure rise may be mitigated by the increase in available volume caused by the deflection of the diaphragm, in some circumstances the pressure may rise to above atmospheric pressure. However, as long as the pressure within the barrel is not high enough to force the outlet valve 3 open, there will be no unwanted discharge of fluid.

Those skilled in the art will also appreciate that while the invention described above uses a flexible diaphragm, in some embodiments part or all of the diaphragm component may be substantially rigid, provided the diaphragm component can be sealed against the piston head 9 and is able to move to a sufficient degree to actuate valve 12.

While the pressure limiting means 10 is shown integrated into the piston 5 in the embodiment described above, in other embodiments (not shown), particularly those in which space is limited, the pressure limiting means may be provided upstream of the barrel inlet. However, it is preferred that the diaphragm be in at least selective fluid communication with the fluid in the barrel.

Figure 4:
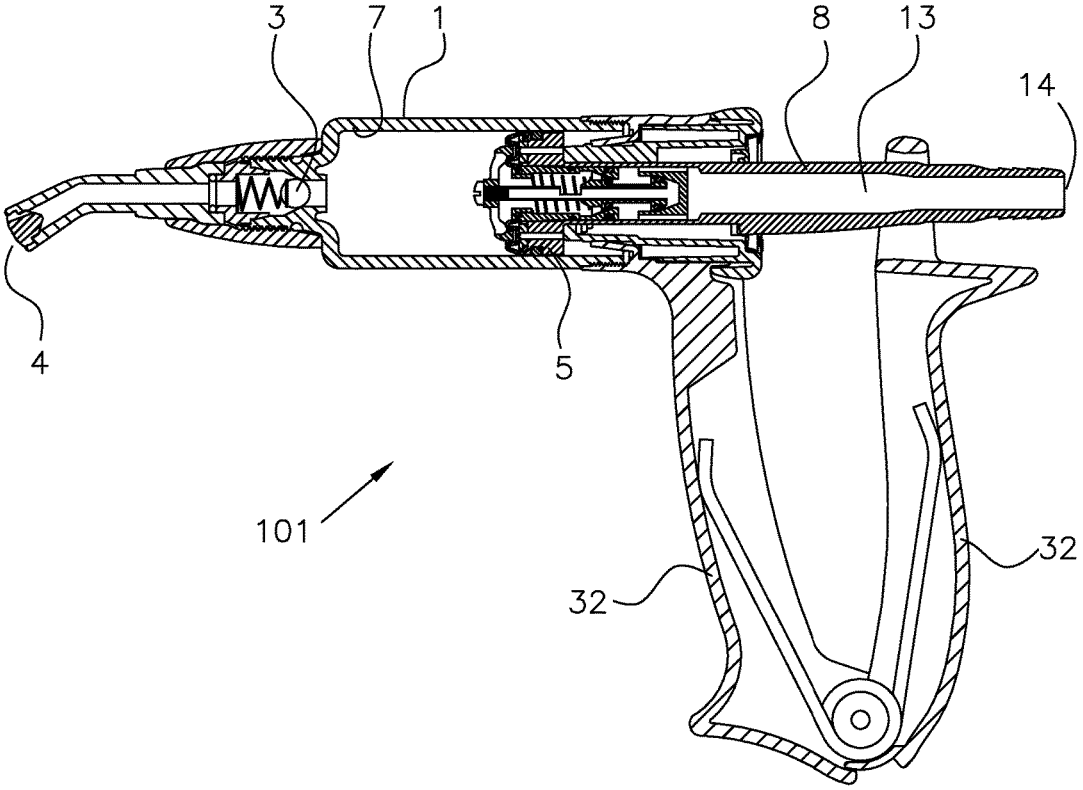
FIG. 4 Is a diagrammatic cross-section side view of an applicator according to a second embodiment of the present invention.
Figure 5:
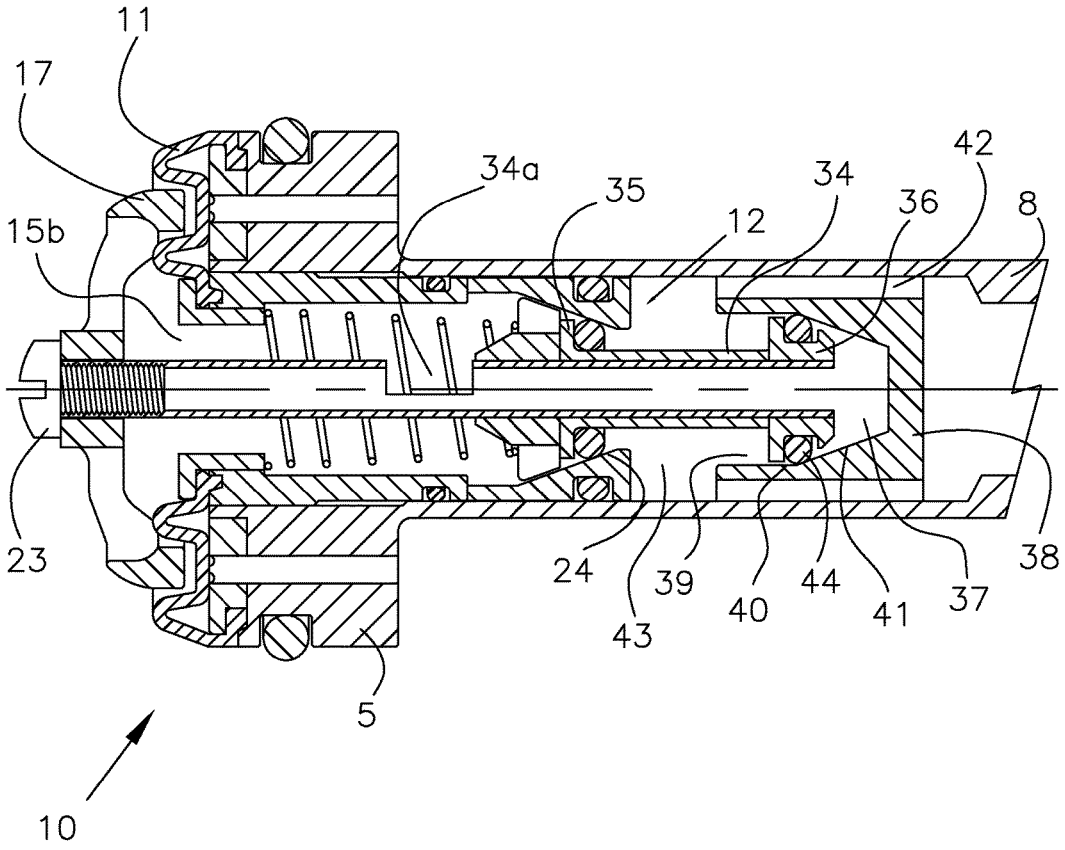
FIG. 5 Is an enlarged diagrammatic cross-section side view of the piston head and pressure limiting means of the applicator shown in FIG. 4 with the pressure limiting valve closed.

Referring next to FIGS. 4 and 5, a second embodiment of the invention is described, with similar reference numerals referring to similar components as in FIGS. 1 to 3.

In the embodiment shown in FIGS. 4 and 5 the valve means 12 is provided with a hollow valve stem 34. The hollow valve stem 34 has one or more openings 34*a* on the downstream side of a valve head 35. The valve stem 34 extends past valve head 35 to a balancing valve head 36.

The hollow valve stem 34 provides a conduit between the opening(s) 34*a* and a chamber 37 on the upstream side of the balancing valve head 36. The chamber 37 is defined by a balancing cylinder formation 38. The balancing cylinder formation 38 has a bore 39 with a substantially cylindrical portion 40 leading into an inwardly tapering portion 41, as shown. The balancing cylinder formation 38 is provided within the hollow pushrod 8. In the embodiment shown the formation 38 is held within the conduit by radial fins 42, and is fixed in place. Fluid is able to flow freely past fins 42 and into a chamber 43 which is upstream of valve seat 24.

The balancing valve head 36 (which is typically provided with a sealing means such as an O-ring 44) is fixed to the hollow valve stem 34.

The operation of the embodiment shown in FIGS. 4 and 5 differs from the operation of the embodiment shown in FIGS. 1-3 as follows.

The hollow valve stem 34 ensures that the pressure in chamber 37 remains close to the pressure immediately downstream of valve head 35, which is in turn approximately equal to the pressure within the barrel 1.

In this way the resultant force from the pressure difference across valve head 35 is essentially balanced by the resultant force from the pressure difference across valve head 36. This greatly reduces the tendency for valve head 35 to open under the influence of a pressure pulse in chamber 43, as the pressure also acts on the forward facing side of valve head 36, creating a substantially equal and opposite force. This means that the opening of valve head 35 is controlled primarily by diaphragm 11, and reduces the influence of the pressure of the fluid on the upstream side of valve head 35.

In the embodiment shown in FIGS. 4 and 5, the balancing valve head 36 has a slightly larger diameter than valve head 35. This means that raised pressure in chamber 43 will actually tend to close valve head 35 more firmly.

To reduce friction, O-ring 44 may not be designed to seal within the cylindrical portion 40 of the balancing cylinder 38. The O-ring seal preferably has only a light interference fit, or a small clearance. Leakage past O-ring seal 44 flows through the hollow valve stem 34 and into the barrel 1. When valve head 35 is closed, O-ring 44 seals in the conical bore 41 of the balancing cylinder formation 38 to prevent leakage.

In an alternative embodiment (not shown) the valve stem 34 may be solid, or may not allow fluid communication between the chamber 37 and the conduit downstream of valve head 35. In such an embodiment a separate conduit may be provided to balance the pressure in the chamber 37 with that immediately downstream of valve head 35.

It is noted that the embodiment shown in FIGS. 4 and 5 does not have a separate component on the downstream side of the piston 5 which carries a one way valve 15*a*. In this embodiment, the barrel inlet 15*b* is in the head of the plunger 5. However, in other alternatives the embodiment shown in FIGS. 1-3 may be used without a separate one way valve 15*a*, and the embodiment shown in FIGS. 4 and 5 may be used with a separate one way valve 15*a*.

While the embodiments shown and described above have a barrel inlet integrated in the piston or plunger, and a barrel outlet provided in an end wall of the barrel, in other embodiments the position of the inlet and outlet may be reversed, while in still further embodiments both the barrel inlet and barrel outlet may be provided at or adjacent the end wall of the barrel.

Figure 6:
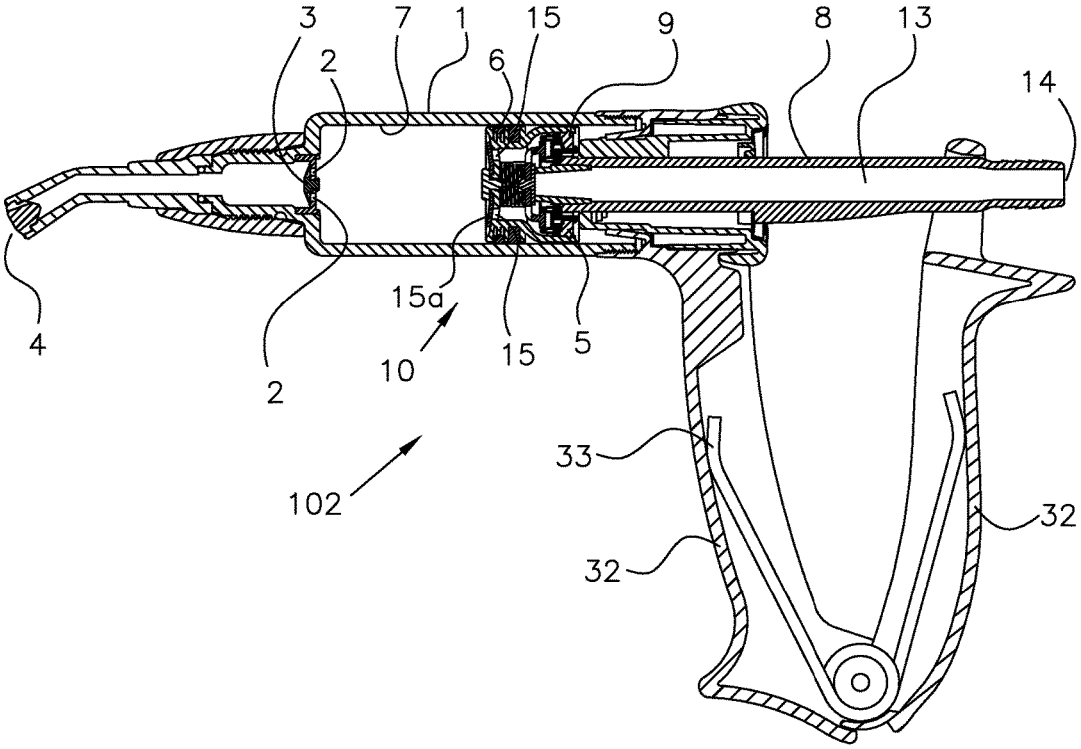
FIG. 6 is a diagrammatic cross-section side view of an applicator according to a third embodiment of the present invention.
Figure 7:
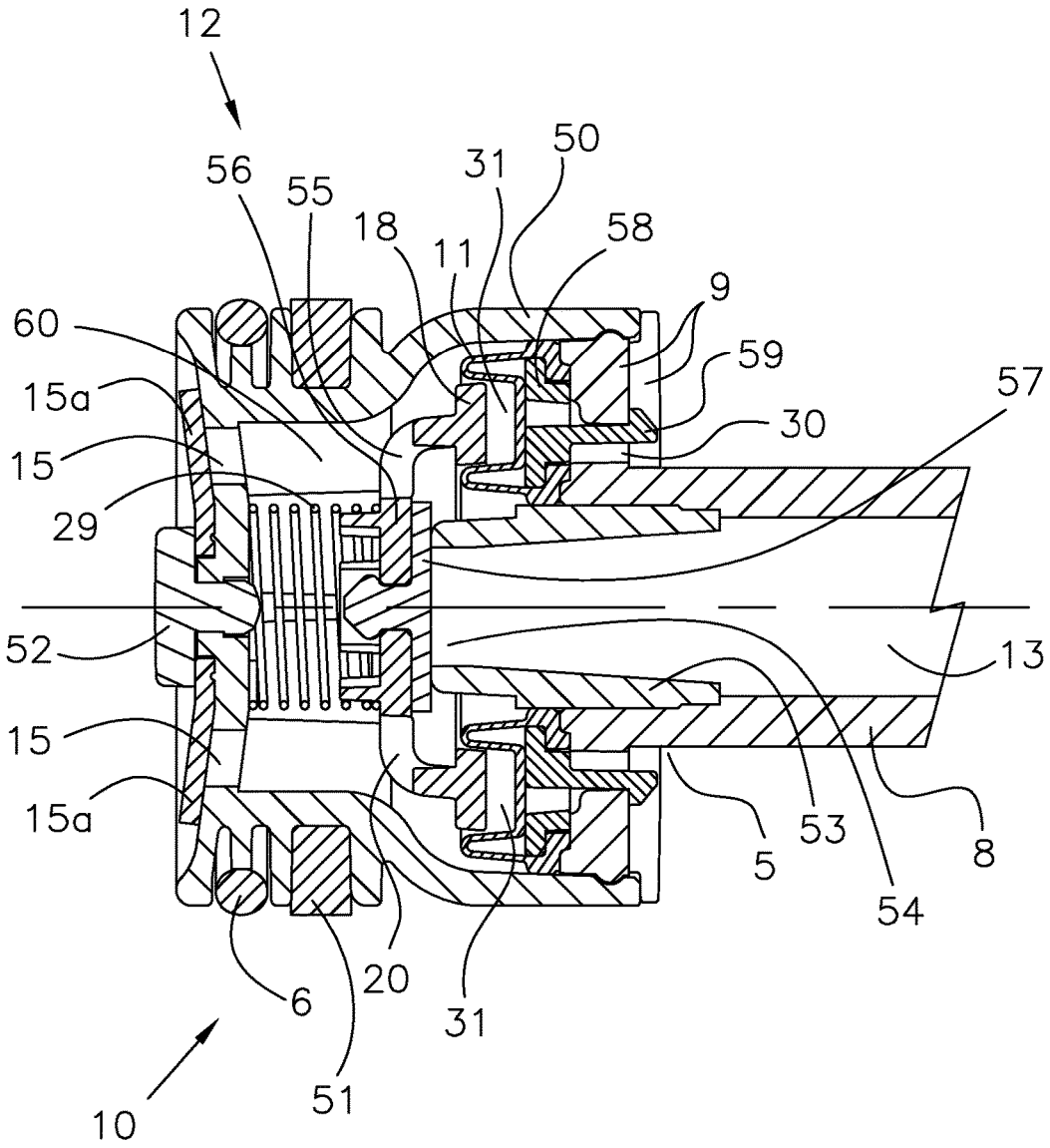
FIG. 7 is an enlarged diagrammatic cross-section side view of the piston head and pressure limiting means of the applicator shown in FIG. 6 with the pressure limiting valve closed.
Figure 8:
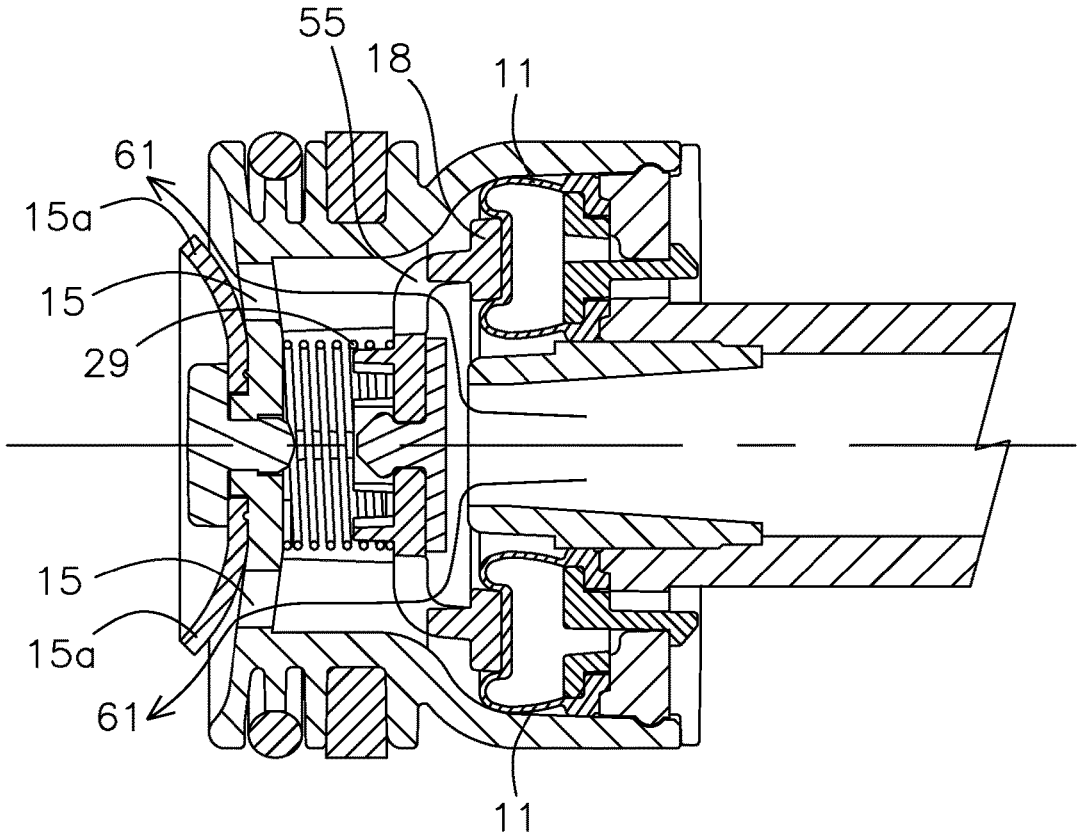
FIG. 8 is an enlarged diagrammatic cross-section side view of the piston head and pressure limiting means of the applicator shown in FIG. 6 with the pressure limiting valve means open, and fluid flowing into the barrel of the applicator.

Referring next to FIGS. 6-8, a further embodiment of the invention is shown which is a variation on the embodiment shown in FIGS. 1-3.

In this embodiment the outlet valve 3 is of a type commonly known as an umbrella valve, selected because of its ability to open at relatively low pressure and therefore reduce the squeeze force required to be applied to handles 32. A valve incorporating a spring, as shown in FIG. 1, could be used instead.

In this embodiment piston 5 has a hollow shaft 8 with fluid passage 13 and a substantially cylindrical piston head 50. O-ring 6 seals the piston head 50 within the barrel. A felt washer 51 is preferably provided on the atmospheric side of the O-ring seal 6. The washer 51 is soaked in oil and provides lubrication.

The barrel inlets 15 are provided by apertures in the piston head 50, and provide a fluid passage into the barrel. In this embodiment the one way valve 15*a* is a valve disc which is held in place by a pin 52.

The piston shaft 8 is fitted with jet component 53 which defines an orifice 54 for fluid to flow into a cavity provided in the piston head 50.

An annular diaphragm 11 is clamped to the piston 5 by a clamp ring 58, held in place by integral clips 59. The clips 59 pass through apertures 30 in the piston 5. These apertures 30 also provide venting to one side of the diaphragm 11.

A force transfer component 55 has an outer ring or hub 18 which is (in this figure) separated from the diaphragm 11 by clearance space 31. The force transfer component 55 has multiple spokes 20 which connect the outer hub 18 to an inner portion 56 which carries a sealing washer 57.

A spring 29 biases the force transfer component 55 and the sealing washer 57 against the jet 53, blocking the orifice 54. In this way the sealing washer 57 functions as a valve head 22, and the end of the jet component 53 functions as a valve seat 24.

A plurality of radially inwardly extending fins 60 define a guide for the spring 29 and the force transfer component 55. The fins 60 may also limit the maximum travel of the force transfer component 55, when the outer rim 18 contacts the fins 60. In this way the fins 60 may limit the opening of the sealing washer 57 from the jet component 53, thereby limiting the flow rate of fluid 61 travelling through the inlet conduits into the barrel. By limiting this flow rate, the magnitude of the pressure pulse created at the end of the barrel refilling stroke may be limited.

As with the embodiment shown in FIGS. 1-3, the use of the diaphragm 11 to provide an opening force on the sealing washer 57 means that the spring 29 can be configured to provide a relatively high closing force, thereby reducing the likelihood that the pressure pulse created when the piston reaches the end of the refilling stroke will pass into and through the barrel. The ability of the diaphragm itself to deflect (effectively increasing the volume of the inlet conduit), thereby absorbing any small amount of fluid which the pressure pulse does force past the pressure limiting means valve head, also reduces the likelihood that fluid will leak from the outlet valve, even if the fluid pressure required to open the outlet valve is low compared to the applicators of the prior art.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the spirit or scope of the invention.

The invention claimed is:

1. An applicator comprising:

a fluid supply inlet;

an outlet;

a barrel having a barrel outlet and a barrel inlet which is in fluid communication, or selective fluid communication, with the fluid supply inlet;

a first valve in fluid communication with the barrel outlet and with the outlet, wherein the first valve is a one way outlet valve;

a piston moveable relative to the barrel and in sealing engagement with the barrel;

a piston actuation means for moving the piston relative to the barrel; and a pressure limiting means for limiting a maximum pressure of fluid entering the barrel from the fluid supply inlet;

wherein the pressure limiting means comprises a diaphragm which is connectable to a second valve having a second valve seat, the second valve seat positioned between the fluid supply inlet and the diaphragm;

wherein the pressure limiting means is configured to allow fluid to flow through the second valve when a pressure of a fluid in the barrel is less than a selected pressure, wherein the selected pressure is less than atmospheric pressure; and wherein the pressure limiting means further comprises a second valve head, wherein the second valve head is on a downstream side of the second valve seat.

2. The applicator of claim 1 wherein the pressure limiting means is configured such that the fluid entering the barrel has a pressure which is at or below an ambient atmospheric pressure.

3. The applicator of claim 1 wherein the pressure limiting means is provided at or adjacent the barrel inlet.

4. The applicator of claim 3 wherein the pressure limiting means is integral with the piston.

5. The applicator of claim 4 wherein the pressure limiting means is adapted to prevent fluid flow from the barrel inlet to the fluid supply inlet.

6. The applicator of claim 1 provided with a third valve for preventing fluid flow from the barrel through the barrel inlet, wherein the third valve is a one way valve.

7. The applicator of claim 1 wherein the pressure limiting means comprises a second valve head and a force transfer component operably connected to the second valve head, wherein the diaphragm urges the force transfer component in a direction which moves the second valve head away from the second valve seat when a pressure of fluid in the barrel is less than atmospheric pressure, and wherein the diaphragm moves out of contact with the force transfer component when the pressure of fluid entering the barrel is greater than atmospheric pressure.

8. The applicator of claim 1 wherein the diaphragm has a substantially central aperture through which fluid flows when the second valve is open.

9. An applicator comprising:

a fluid supply inlet;

an outlet;

a barrel having a barrel outlet and a barrel inlet which is in fluid communication, or selective fluid communication, with the fluid supply inlet;

a first valve in fluid communication with the barrel outlet and with the outlet, wherein the first valve is a one way outlet valve;

a piston moveable relative to the barrel and in sealing engagement with the barrel;

a piston actuation means for moving the piston relative to the barrel; and a pressure limiting means for limiting a maximum pressure of fluid entering the barrel from the fluid supply inlet, wherein the pressure limiting means comprises a diaphragm which is connectable to a second valve having a second valve seat, the second valve seat positioned between the fluid supply inlet and the diaphragm, wherein the pressure limiting means is configured to allow fluid to flow through the second valve when a pressure of a fluid in the barrel is less than a selected pressure, wherein the selected pressure is less than atmospheric pressure, wherein applicator comprises a third valve for preventing fluid flow from the barrel through the barrel inlet, wherein the third valve is a one way valve.

10. The applicator of claim 9 wherein the pressure limiting means is configured such that the fluid entering the barrel has a pressure which is at or below an ambient atmospheric pressure.

11. The applicator of claim 9 wherein the pressure limiting means is provided at or adjacent the barrel inlet.

12. The applicator of claim 11 wherein the pressure limiting means is integral with the piston.

13. The applicator of claim 9 wherein the pressure limiting means further comprises a second valve head and biasing means for biasing the second valve head toward the second valve seat.

14. An applicator comprising:

a fluid supply inlet;

an outlet;

a barrel having a barrel outlet and a barrel inlet which is in fluid communication, or selective fluid communication, with the fluid supply inlet;

a first valve in fluid communication with the barrel outlet and with the outlet, wherein the first valve is a one way outlet valve;

a piston moveable relative to the barrel and in sealing engagement with the barrel;

a piston actuation means for moving the piston relative to the barrel; and a pressure limiting means for limiting a maximum pressure of fluid entering the barrel from the fluid supply inlet, wherein the pressure limiting means comprises a diaphragm which is connectable to a second valve having a second valve seat, the second valve seat positioned between the fluid supply inlet and the diaphragm, wherein the pressure limiting means is configured to allow fluid to flow through the second valve when a pressure of a fluid in the barrel is less than a selected pressure, wherein the selected pressure is less than atmospheric pressure, wherein the pressure limiting means comprises a second valve head and a force transfer component operably connected to the second valve head, wherein the diaphragm urges the force transfer component in a direction which moves the second valve head away from the second valve seat when a pressure of the fluid in the barrel is less than atmospheric pressure, and wherein the diaphragm moves out of contact with the force transfer component when the pressure of fluid entering the barrel is greater than atmospheric pressure.

15. An applicator comprising:

a fluid supply inlet;

an outlet;

a barrel having a barrel outlet and a barrel inlet which is in fluid communication, or selective fluid communication, with the fluid supply inlet;

a first valve in fluid communication with the barrel outlet and with the outlet, wherein the first valve is a one way outlet valve;

a piston moveable relative to the barrel and in sealing engagement with the barrel;

a piston actuation means for moving the piston relative to the barrel; and a pressure limiting means for limiting a maximum pressure of fluid entering the barrel from the fluid supply inlet, wherein the pressure limiting means comprises a diaphragm which is connectable to a second valve having a second valve seat, the second valve seat positioned between the fluid supply inlet and the diaphragm, wherein the pressure limiting means is configured to allow fluid to flow through the second valve when a pressure of a fluid in the barrel is less than a selected pressure, wherein the selected pressure is less than atmospheric pressure, wherein the diaphragm has a substantially central aperture though which fluid flows when the second valve is open.

16. An applicator comprising:

a fluid supply inlet;

an outlet;

a barrel having a barrel outlet and a barrel inlet which is in fluid communication, or selective fluid communication, with the fluid supply inlet;

a first valve in fluid communication with the barrel outlet and with the outlet, wherein the first valve is a one way outlet valve;

a piston moveable relative to the barrel and in sealing engagement with the barrel;

a piston actuation means for moving the piston relative to the barrel; and a pressure limiting means for limiting a maximum pressure of fluid entering the barrel from the fluid supply inlet, wherein the pressure limiting means comprises a diaphragm which is connectable to a second valve having a second valve seat, the second valve seat positioned between the fluid supply inlet and the diaphragm, wherein the pressure limiting means is configured to allow fluid to flow through the second valve when a pressure of a fluid in the barrel is less than a selected pressure, wherein the selected pressure is less than atmospheric pressure, wherein the pressure limiting means comprises a second valve head, a third valve head and third valve seat, wherein the third valve head is connected to the second valve head and moves with the second valve head.

17. The applicator of claim 16 wherein a pressure difference across the second valve head is substantially equal to a pressure difference across the third valve head.

18. The applicator of claim 16 wherein a pressure difference across the second valve head creates a resultant force in a first direction and a pressure difference across the third valve head creates a resultant force in a second direction which is opposite to the first direction.

19. The applicator of claim 18 wherein the resultant in the first direction is substantially equal to the resultant force in the second direction.

20. The applicator of claim 18 wherein a resultant force on the third valve head is greater than a resultant force on the second valve head.

* * * * *